US006987498B2

(12) United States Patent
Ikeda et al.

(10) Patent No.: US 6,987,498 B2
(45) Date of Patent: Jan. 17, 2006

(54) DISPLAY UNIT AND DISPLAY METHOD

(75) Inventors: Jun Ikeda, Fukuoka (JP); Shuichi Ojima, Fukuoka (JP); Tsuyoshi Hirashima, Fukuoka-Ken (JP); Ryota Hata, Iizuka (JP); Shinya Kiuchi, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 293 days.

(21) Appl. No.: 09/989,593

(22) Filed: Nov. 20, 2001

(65) Prior Publication Data

US 2002/0080146 A1 Jun. 27, 2002

(30) Foreign Application Priority Data

Nov. 21, 2000 (JP) ..... 2000-354063

(51) Int. Cl.
*G09G 5/02* (2006.01)

(52) U.S. Cl. ..... 345/88; 345/690; 345/602; 345/605; 345/597; 345/550

(58) Field of Classification Search ..... 345/597–605, 345/690, 77, 72, 83, 88–89, 204, 549–550, 345/87, 99–103, 694, 615, 645
See application file for complete search history.

(56) References Cited

U.S. PATENT DOCUMENTS 4,725,828 A * 2/1988 Cowlishaw ..... 345/694
4,970,663 A * 11/1990 Bedell et al. ..... 382/232
5,065,144 A * 11/1991 Edelson et al. ..... 345/555
5,081,450 A * 1/1992 Lucas et al. ..... 345/615
5,142,272 A * 8/1992 Kondo ..... 345/550
5,170,152 A * 12/1992 Taylor ..... 345/605
5,394,518 A * 2/1995 Friedman et al. ..... 345/593
5,469,190 A * 11/1995 Masterson ..... 345/605
5,649,083 A * 7/1997 Barkans et al. ..... 345/597
6,052,113 A * 4/2000 Foster ..... 345/596
6,084,561 A * 7/2000 Kudo et al. ..... 345/89
6,654,026 B2 * 11/2003 Lee ..... 345/600

FOREIGN PATENT DOCUMENTS

JP 6-138858 5/1994
JP 9-50262 2/1997

OTHER PUBLICATIONS

Rec. ITU-R BT.0709-4, International Telecommunication Union- Radio Communication Sector, Recommendations, Broadcasting Service (Television), 2000.

* cited by examiner

*Primary Examiner*—Lun-Yi Lao
(74) *Attorney, Agent, or Firm*—Darby & Darby

(57) ABSTRACT

A pseudo-tone processing means color-reduces each RGB component of incoming display data using pseudo-tone processing. A frame memory stores the color-reduced display data before feeding it to a display through a drive means. Color reduction is performed so that the tone number of each RGB component after color reduction is G component>R component>B component. Color reduction is unequally performed in a manner which reflects contributions of each RGB component to brightness.

22 Claims, 6 Drawing Sheets

3→6bit conversion table
5→6bit conversion table
4→6bit conversion table

| 4bit value | 6bit value |
|---|---|
| 0 | 0 |
| 1 | 3 |
| 2 | 10 |
| 3 | 12 |
| 4 | 15 |
| 5 | 17 |
| 6 | 19 |
| 7 | 20 |
| 8 | 22 |
| 9 | 24 |
| 10 | 25 |
| 11 | 27 |
| 12 | 29 |
| 13 | 32 |
| 14 | 35 |
| 15 | 40 |
| 16 | 63 |

3→6bit conversion table

5→6bit conversion table

4→6bit conversion table

| 4bit value | 6bit value |
|---|---|
| 0 | 0 |
| 1 | 3 |
| 2 | 10 |
| 3 | 12 |
| 4 | 15 |
| 5 | 17 |
| 6 | 19 |
| 7 | 20 |
| 8 | 22 |
| 9 | 24 |
| 10 | 25 |
| 11 | 27 |
| 12 | 29 |
| 13 | 32 |
| 14 | 35 |
| 15 | 40 |
| 16 | 63 |

DISPLAY UNIT AND DISPLAY METHOD

BACKGROUND OF THE INVENTION

1. Field of the Invention

The present invention relates to a display unit which color-reduces multi-tone display data by means of a systematic dither method or an error diffusion method for storage in a frame memory and carries out display and a method therefor.

2. Description of the Prior Art

A prior-art method color-reduces multi-tone display data using a systematic dither method or an error diffusion method for displaying the display data on a display unit such as an LCD or the like having a small number of tone-representing bits.

Originally, this method was employed because multi-tone representation was difficult in terms of the performance of a display device itself such as an LCD or the like.

However, in recent years, through improvements in tone-representing performance of the device itself, rather than in reductions in display memory, there are a growing number of cases where the unit electric power consumption and costs are reduced by design.

Japanese Unexamined Patent Publication No. Hei-9-50262 discloses a technique in which the systematic dither method is employed.

Japanese Unexamined Patent Publication No. Hei-6-138858 discloses a technique in which the error diffusion method is employed.

In these publications, multi-bit display data (for example, each RGB component has 8 bits, 6 bits or the like) is color-reduced to 12 bits (4,096 colors). Hereinafter, for convenience of explanation, an example where multi-bit data is color-reduced to 12 bits (4,096 colors) is cited. However, the present invention is also applicable to a case where another color reduction is carried out, as long as it does not deviate from the spirit of the invention.

In such publications, when performing the color reduction to 12 bits (4,096 colors), 4 bits are distributed to each RGB component, respectively. In addition, there are examples of an 8-bit color system provided as R:G:B=3:3:2 (bits) and a 16-bit color system provided as R:G:B= 5:6:5 (bits). These ratios are based on the idea that it is satisfactory that the bit numbers are roughly uniformly allotted among the RGB. When the bit number is not completely uniformly assigned, 1 bit is merely reduced (8 bits) or increased (16 bits) at the most.

However, such distribution deviates from human visual performance, detailed reasons of which will be described later. As a result, the display quality is poor due to the G component being too small Also, the amount of information is wasted due to the B component being too large.

In more detail, since the G component is too small, a sense of unevenness between adjacent pixels, a pseudo-outline may result. Since the B component is too large, the requisite amount of memory unnecessarily increases, causing wasteful electric power consumption and rising costs. This drawback is the first problem.

Now, the second problem, which relates to a second object of the present invention, will be described referring to FIG. 8 through FIG. 11. FIG. 8 is a block diagram of a prior display unit.

In FIG. 8, a pseudo-tone processing means 1 receives inputs of display data (in the present example, each RGB has 6 bits, however, each RGB may have 8 bits) and color-reduces the data by pseudo-tone processing so that each RGB has 4 bits and the total becomes 12 bits (4,096 colors). Herein, the pseudo-tone processing by the pseudo-tone processing means 1 may be either a systematic dither method or an error diffusion method.

A frame memory 2 stores the data after color deduction to be output from the pseudo-tone processing means 1. Herein, since each RGB is color-reduced to 4 bits, the frame memory 2 has a capacity to store 12 bits per one pixel.

A drive means 3 drives an LCD 4 based on the data of the frame memory 2. Herein, the LCD 4 is used as a display device, however, a CRT or a plasma display may be used.

And, in the prior art, display has been carried out with each RGB of 4 bits based on the color-reduced data, which is stored in the frame memory 2.

In recent years, owing to the advancement of technology, an LCD can display 6 bits (64 tones) in some cases. Illustration of reflectance characteristics of the LCD which can display 64 tones is as shown in FIG. 9.

In addition, illustration of reflectance characteristics of an LCD with 4 bits (16 tones) after color reduction is as shown in FIG. 10.

When driving an LCD in a practical manner, the more visually uniform the intervals of the tone data, the more smoothly the tones change, and unclear colors and the like can be prevented.

Therefore, in order to cancel out the reflectance characteristics of FIG. 1, carrying out a correction using the characteristics of FIG. 11 by means of the drive means 3 of FIG. 8 can be considered.

However, in the prior art, as can be clearly understood referring to FIG. 11, tones that can be displayed become dispersive even after this correction. This point is particularly remarkable in halftones where irregular colors easily become conspicuous, thus the display quality of appearance has been unsatisfactory. This drawback is the second problem.

OBJECTS AND SUMMARY OF THE INVENTION

In view of the first problem it is a first object of the present invention to provide a display unit which can obtain beautiful display results with a small amount of information and a method therefor.

In view of the second problem it becomes the second object of the present invention to provide a display unit which can maintain the display quality of the appearance while saving the memory capacity by color reduction and a method therefor.

Briefly stated, the present invention provides a pseudo-tone processing means which color-reduces each RGB component of incoming display data using pseudo-tone processing. A frame memory stores the color-reduced display data before feeding it to a display through a drive means. Color reduction is performed so that the tone number of each RGB component after color reduction is G component>R component>B component. Color reduction is unequally performed in a manner which reflects contributions of each RGB component to brightness.

According to an embodiment of the invention, there is provided a display unit comprising: a display device, a pseudo-tone processing means for receiving inputs of display data, means in the pseudo-tone processing means for color-reducing each RGB component of the display data by pseudo-tone processing to produce color-reduced display data, the pseudo-tone processing means includes means for performing color reduction so that the tone number reflects a contribution of each RGB component to brightness, a frame memory for storing the color-reduced display data, and a drive means for driving the display device with the color-reduced display data from the frame memory.

According to a feature of the invention, there is provided a display unit comprising: a display device, a pseudo-tone processing means for receiving inputs of display data, means in the pseudo-tone processing means for color-reducing each RGB component of the display data by means of pseudo-tone processing to produce color-reduced display data, a frame memory for storing the color-reduced display data, a drive means for driving the display device using data derived from the color-reduced display data stored in the frame memory, the pseudo-tone processing means including means for performing color reduction so that the tone number of bits in each RGB component after color reduction becomes G component>R component>B component.

According to a further feature of the invention, there is provided a display unit comprising: a display device, a pseudo-tone processing means which receives inputs of display data, means in the pseudo-tone processing means for color-reducing each RGB component of the display data by means of pseudo-tone processing to produce color-reduced display data, a frame memory for storing the color-reduced display data, a tone correction means for bit-incrementing the color-reduced display data stored in the frame memory, and a drive means for driving the display device using the bit-incremented display data.

According to a still further feature of the invention, there is provided a display method comprising the steps of: receiving input display data, color-reducing each RGB component of the display data by means of pseudo-tone processing to produce color-reduced display data, storing the color-reduced display data in a frame memory, driving a display device using data derived from the color-reduced display data stored in the frame memory, the step of color-reducing setting a tone number of each RGB component after color reduction as G component>R component>B component.

According to yet another feature of the invention, there is provided a display method comprising the steps of: receiving input display data, color-reducing each RGB component of the display data by means of pseudo-tone processing to produce color-reduced display data, storing the color-reduced display data in a frame memory, driving a display device using data derived from the color-reduced display data stored in the frame memory, the step of color-reducing includes setting tone number to reflect a contribution of each RGB component to brightness.

According to still another feature of the invention there is provided a display method comprising the steps of: receiving input of display data, color-reducing each RGB component of the display data by means of pseudo-tone processing to produce color-reduced display data, storing the color-reduced display data in a frame memory, bit-incrementing the display data after the step of color-reducing stored in the frame memory to produce bit-incremented display data, and driving a display device with the bit-incremented display data.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
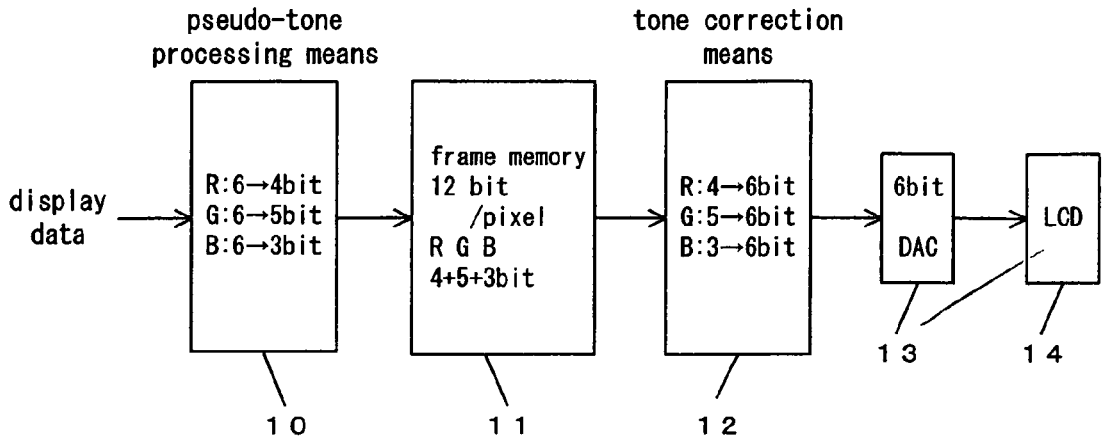
FIG. 1 is a block diagram of the display unit according to an embodiment of the invention.

A display unit according to the first aspect of the present invention comprises a display device, a pseudo-tone processing means which receives inputs of display data and color-reduces each RGB component of said display data by means of pseudo-tone processing, a frame memory for storing the color-reduced display data, and a drive means for driving the display device by means of data derived from the display data stored in the frame memory, wherein the pseudo-tone processing means performs color reduction so that the tone number reflects a contribution of each RGB component to brightness.

A display unit according to the second aspect of the present invention comprises a display device, a pseudo-tone processing means which receives inputs of display data and color-reduces each RGB component of said display data by means of pseudo-tone processing, a frame memory for storing the color-reduced display data, and a drive means for driving the display device by means of data derived from the display data stored in the frame memory, wherein the pseudo-tone processing means performs color reduction so that the tone numbers of each RGB component after color reduction becomes:

G component>R component>B component.

By these constructions, each RGB component can be color-reduced in line with human visual performance and beautiful display results can be obtained with a small amount of information.

In a display unit according to the third aspect of the present invention, the tone number of the G component after color reduction is more than two times and not more than 20 times the tone number of the B component.

Furthermore, in a display unit according to the fourth aspect of the present invention, the tone numbers after color reduction are:

R component:G component:B component=2:4:1.

By these constructions, each RGB component after color reduction can be set to a distribution which reflects the contribution to brightness.

In a display unit according to the fifth aspect of the present invention, the tone numbers after color reductions are:

R component=16, G component=32, and B component=8.

By this construction, each RGB component after color reduction becomes a power of 2 and can be easily constructed in the hardware.

A display unit according to the sixth aspect of the present invention comprises a display device, a pseudo-tone processing means which receives inputs of display data and color-reduces each RGB component of said display data by means of pseudo-tone processing, a frame memory for storing the color-reduced display data, a tone correction means for bit-incrementing the display data stored in the frame memory, and a drive means for driving the display device by means of the bit-incremented display data.

By this construction, a series of processes for color-reducing, storing, bit-incrementing, and displaying can be carried out. Thus, a smoother tone display becomes possible with the same amount of memory as that of the prior art.

In a display unit according to the seventh aspect of the present invention, a display device is an LCD.

By this construction, the display unit can be applied to electronic instruments that require portability such as mobile phones, mobile computers and the like.

Figure 2:
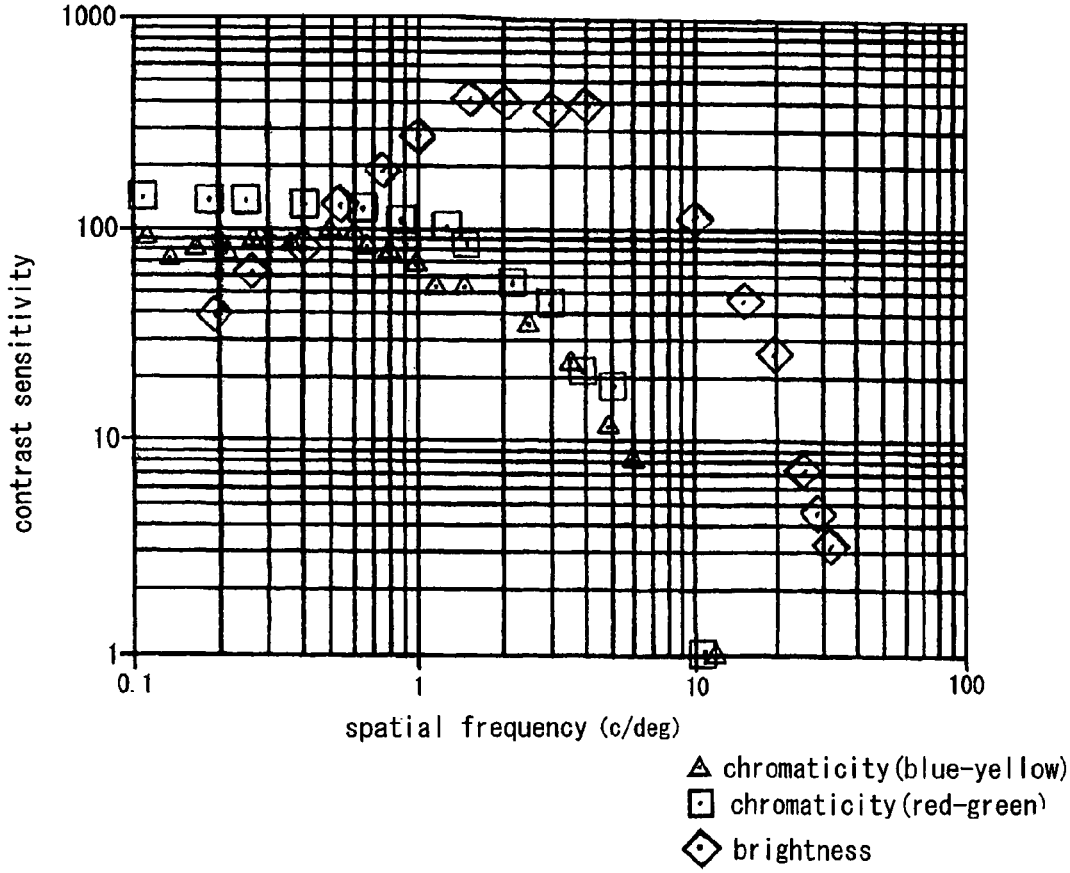
FIG. 2 is a graph showing spatial frequency characteristics of visibility according to the invention.

The physiology of human visibility has the spatial frequency characteristics shown in FIG. 2. Herein, the horizontal axis indicates spatial frequency (c/deg) and the vertical axis indicates contrast sensitivity. The plot of rhombuses represents brightness data, the plot of squares represents chromaticity data (red-green), and the plot of triangles represents chromaticity data (blue-yellow).

Contrast sensitivity means the reciprocal number of a contrast threshold. The contrast threshold is a minimum contrast that a human can perceive. The minimum contrast was determined by showing stripes following a sine-wave pattern where the brightness or chromaticity spatially changes (the average brightness or average chromaticity is constant).

In addition, the spatial frequency is a sine-wave pattern frequency that has been converted to an angle of field of a human (deg).

The brightness or the chromaticity shows a downward-sloping tendency where the contrast sensitivity falls as the spatial frequency increases. At a certain spatial frequency or higher, the contrast sensitivity becomes 1 and it becomes impossible to perceive the stripes. Such a fall occurs at a smaller spatial frequency in chromaticity rather than in the brightness.

In detail, at a spatial frequency on the order of 10 (deg), even if changes (herein, the interval between the stripes: to be exact, the wavelength of a sine wave pattern) exist in chromaticity, humans are deceived into perceiving the chromaticity as uniform. However, humans can stir detect changes in brightness.

The human angle of field is an angle created by two line segments which link the viewpoint of an eye with both sides of the object of observation. This is true even when the viewpoint is fixed and the distance between the viewpoint and the object of observation is also fixed. If the ends of the object of observation have different widths, the angle of field results in different values.

Figure 3:
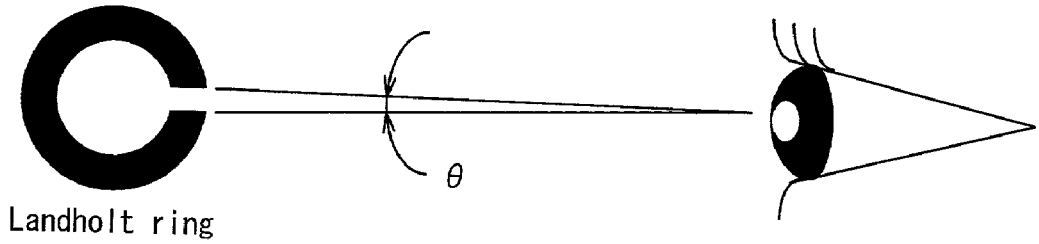
FIG. 3 is an explanatory view of vision according to the invention.

As shown in FIG. 3, the angle of field is frequently used in vision tests. In vision tests, a board on which various large and small Landholt rings (each of which forms a C-shape having one gap) are arranged is shown to a subject.

The subject stares with one eye at a Landholt ring specified by the examiner from a position located a fixed distance from the board. The subject answers questions as to whether he/she can perceive the gaps and the direction of the gaps. A vision of "1.0" or more means that the subject can perceive a gap if the gap of the Landholt ring has an angle of field of 0.1 degrees.

Based on the above premises, the angle of field and spatial frequency characteristics of sight will now be described.

A display unit has a large number of pixels arranged in a lengthwise and breadthwise array. This is true in the cases of a CRT or an LCD. An image is displayed based on the RGB component values of each pixel.

Figure 4:
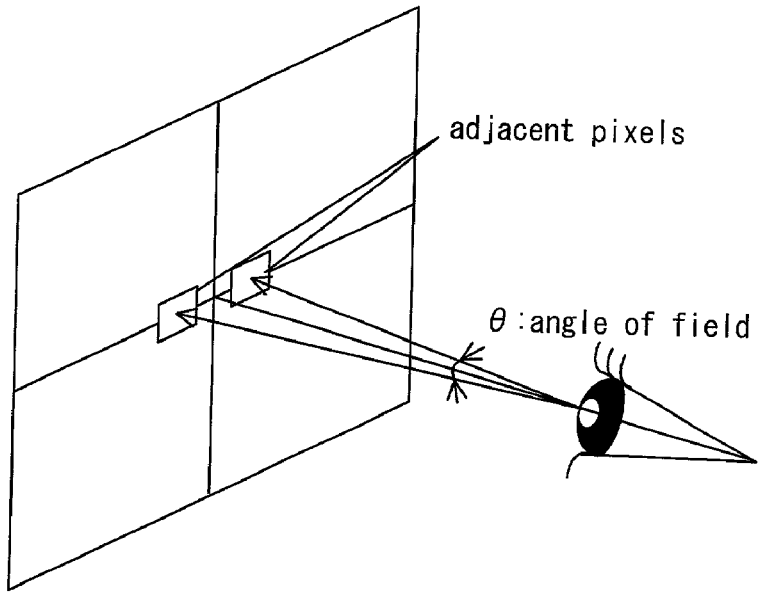
FIG. 4 is an explanatory view of the angle of field of the display unit according to the invention.

When the "interval between stripes" is replaced by the pitch between adjacent pixels as shown in FIG. 4, the aforementioned premises can be applied to visual recognition of the display unit.

In order to regulate the angle of field, the observation distance (the distance between the viewpoint and the object of observation) must be fixed. Therefore, in the present example, the observation distance is assumed to be 30 cm. This observation distance is determined by assuming a common knowledge value as the distance between a display unit which is carried about and an eye of a human who looks thereat. Therefore, the present invention can be similarly carried out with any other arbitrarily applied value.

Once the observation distance is assumed, the horizontal axis, the "spatial frequency (c/deg)" of FIG. 2 can be converted to "display resolution (PPI: pixels per inch)" of the display unit. The conversion results are illustrated in FIG. 5.

Figure 5:
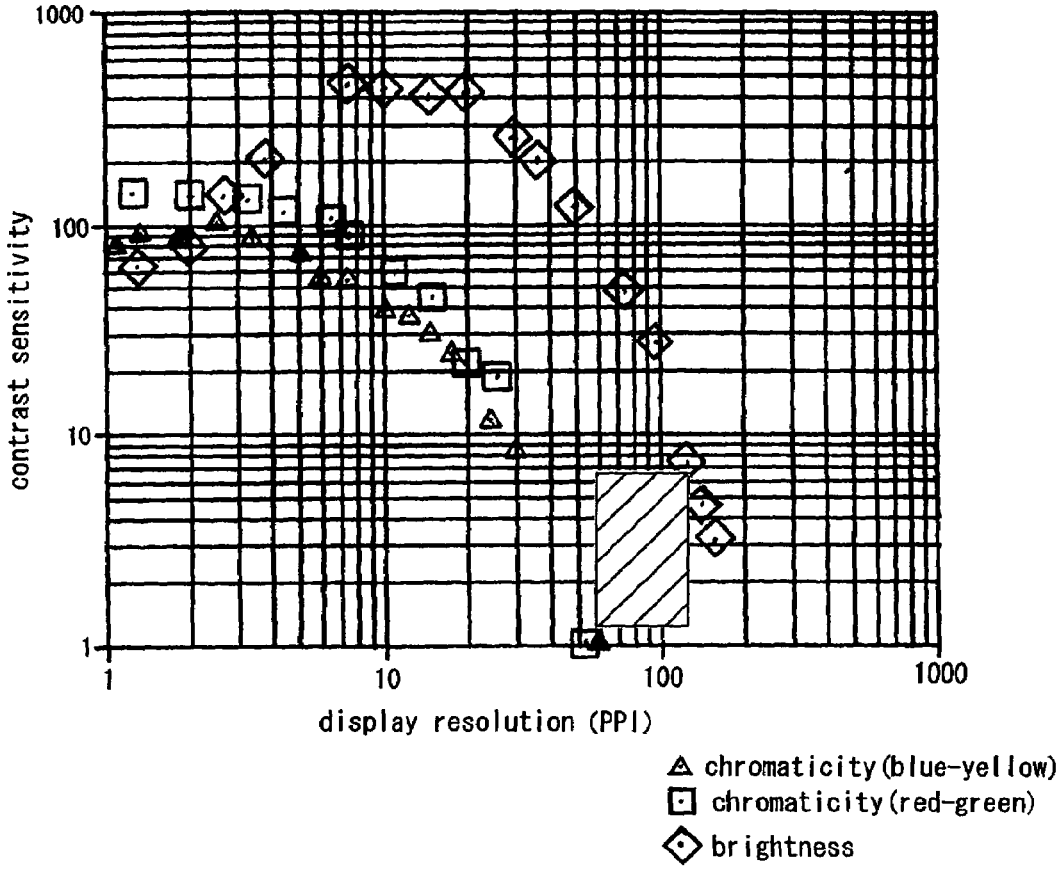
FIG. 5 is a graph showing spatial frequency characteristics of visibility at adjacent pixels according to the invention.

Referring to FIG. 5, when the observation distance is on the order of 30 cm, and the display resolution is on the order of 100 ppi, which is typical of LCDs, a human can perceive changes between adjacent pixels in terms of chromaticity. Under the same conditions, he/she cannot perceive such changes in terms of brightness and is deceived into perceiving that the chromaticity is uniform.

The above knowledge is used in a technique to make phenomena, which degrade the image quality of appearance, such as a sense of unevenness between adjacent pixels, a pseudo-outline and the like, inconspicuous in a display unit which performs color reduction by pseudo tones.

A resolution effective for making such phenomena inconspicuous becomes "in terms of each RGB component, providing more tones for a component having a high contribution to brightness, thereby improving the display quality and, at the same time, allotting fewer tones for a component having a low contribution to brightness, thereby reducing the amount of information".

For CRTs and LCDs, which are typical of display units, the contribution of each RGB component to brightness and the tone numbers distributing ratio depending thereon will be put in order.

For a CRT, according to ITU-R BT. 709, the brightness conversion coefficients are R=0.213, G=0.715, and B=0.072.

Normalizing to the B component which makes the smallest brightness, the conversion coefficient corresponds roughly to the ratio of the contributions to brightness of:

R:G:B=3.0:9.9:1.0.

Accordingly, it is desirable for the CRT having such characteristics to make, in principle, the tone numbers distributing ratio proportional to the ratio of the contributions to brightness as close as possible to:

R:G:B=3:10:1.

For reflective LCDs, the inventors of the present invention have measured the brightness conversion coefficients as:

R=0.255, G=0.473, and B=0.131

Again normalizing to the B component having the smallest brightness conversion coefficient. the ratio should be as close as possible to the following contributions to brightness:

R:G:B=1.9:3.6:1.0.

Accordingly, it is desirable for a reflective LCD having such characteristics to make, in principle, the tone numbers distributing ratio proportional to the following ratio of the contributions to brightness:

R:G:B=2:4:1 or 2:3:1.

For a transmissive LCD, the measured values of the brightness conversion coefficients are:

R=0.259, G=0.622, and B=0.119

Normalizing to the B component, which makes the smallest brightness conversion coefficient the ratio of the contributions to brightness is:

R:G:B=2.2:5.2:1.0.

Accordingly, it is desirable for a transmissive LCD having such characteristics to make, in principle, the tone numbers distributing ratio proportional to the ratio of the contributions to brightness as

R:G:B=2:5:1.

As has been described above, in the case of either the CRT or LCD, of the respective RGB components, the G component has the greatest contribution to brightness, the R component contribution is smaller, and the B component makes the smallest contribution to brightness.

In addition, the contribution to brightness of the G component is in a range of three times to ten times that of the B component. Accordingly, in the present embodiment, the tone number of the G component is set to a range of between three and ten times after color reduction.

However, from the viewpoint of practical use, it is permissible to set the tone number of the G component to a range of between two and 20 times.

The reason that the upper limit may be set as high as "20 times" is that the inventors are aware of an LCD that may require this value. In this LCD, the peak wavelengths of respective light-emitting elements which emit three RGB primary colors are $\lambda R=630$ nm, $\lambda G=530$ nm, and $\lambda B=470$ nm,.

CIE-xy chromaticity coordinate values of the respective RGB primary colors are:

in terms of R, (x, y)=(0.707957, 0.292043)

in terms of G, (x, y)=(0.154716, 0.805833)

in terms of B, (x, y)=(0.124142, 0.057814)

The ratio of contributions to brightness of the respective RGB light-emitting elements of this LCD is R:G:B=5:14:1.

For construction in hardware, it is preferable that each value of the ratio be powers of 2. Using powers of 2 reduces waste in hardware and permits reducing the scale of hardware required.

When taking the above points into consideration, it is desirable to set the tone numbers distributing ratio to R:G:B=2:4:1. For example, for carrying out a 4,096 color-display by means of color components of 12 bits, it is optimal to set the bit distribution to R=4 bits, G=5 bits, and B=3 bits.

In the above, description of the principle of the present invention is concluded and concrete construction of the display unit according to the present embodiment is now described with reference to FIG. 1, FIG. 6, and FIG. 7.

In FIG. 1, a pseudo-tone processing means 10 receives inputs of display data (in the present example, each RGB has 6 bits, however, each RGB may have 8 bits.) and color-reduces the data by pseudo-tone processing so that the total number of bits is 12, which is sufficient for 4,096 colors. In accordance with the aforementioned principle, the pseudo-tone processing means 10 color-reduces the R component to 4 bits, the G component to 5 bits, and the B component to 3 bits, respectively. The pseudo-tone processing by the pseudo-tone processing means 10 may be either a systematic dither method or an error diffusion method.

Figure 8:
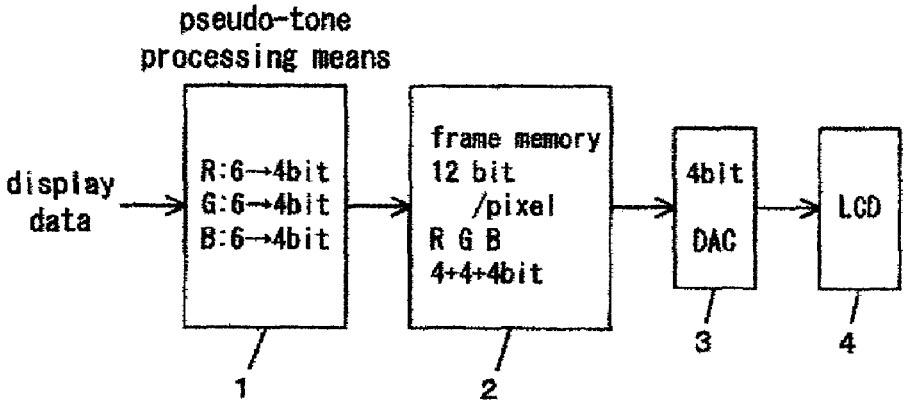
Fig. 8 PRIOR ART
FIG. 8 is a block diagram of a prior display unit.
Figure 9:
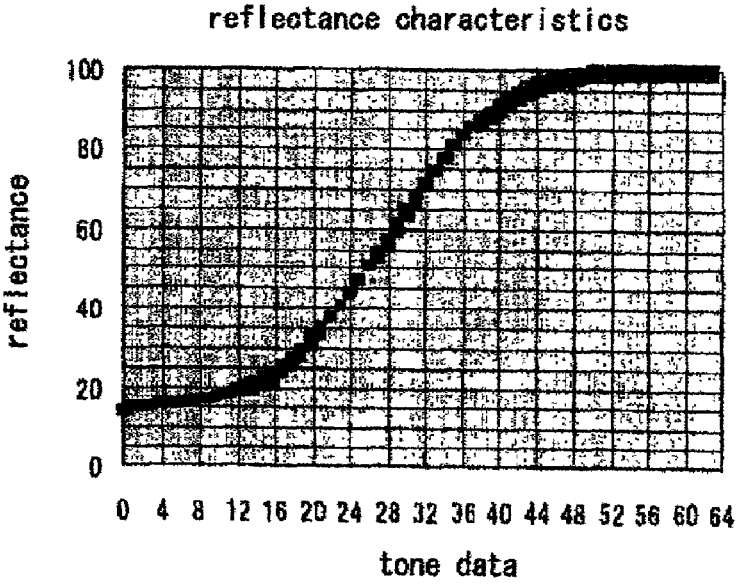
Fig. 9 PRIOR ART
FIG. 9 is a graph showing reflectance characteristics of the LCD according to the invention.
Figure 10:
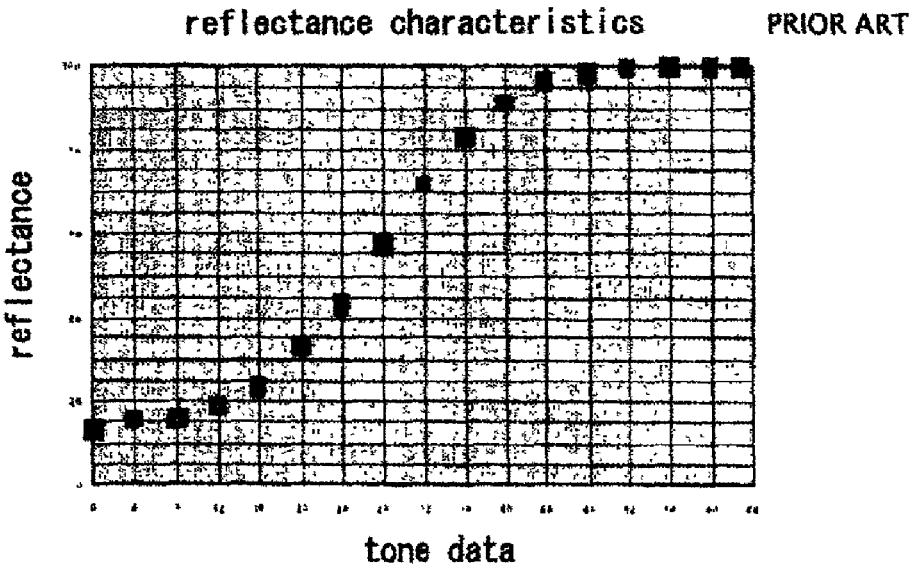
FIG. 10 is a graph showing reflectance characteristics according to the invention.

A frame memory 11 stores the data after color-deduction output by the pseudo-tone processing means 1. In the present example, similar to FIG. 8 showing the prior art, the frame memory 11 has the capacity to store 12 bits per pixel. Accordingly, electric power consumption and costs are approximately the same as those of the prior art.

However, in accordance with the aforementioned principle, the frame memory 11 stores the R component as 4 bits, the G component as 5 bits, and the B component as 3 bits, respectively, per pixel.

Unlike the prior art, in the present embodiment, as shown in FIG. 1, 12 bit-data of the frame memory 11 is not directly output to a drive means 13. Instead, but the 12-bit-data of the frame memory 11 is corrected to 18-bit-data by a tone correction means 12, located downstream of the frame memory 11. The output of the tone correction means 12 is output to the drive means 13.

In detail, drive means 13 can be an LCD driver LSI, a drive circuit mounted on an LCD substrate, a DA converter circuit for a CRT, a drive circuit for a plasma display or the like.

Tone correction means 12 corrects the R component of 4 bits, the G component of 5 bits, and the B component of 3 bits to be data of 6 bits, respectively. In detail, using the one-dimensional bit conversion table shown in FIG. 6, each color-reduced component is bit-incremented. Herein, each component is bit-incremented to 6 bits (64 tones), however, it may be bit-incremented to any other convenient bit value.

Procedures are now described for bit-incrementing the R component of 4 bits to 6 bits. With respect to the G component (5 bits to 6 bits) and the B component (3 bits to 6 bits), only the numerical values are different and similar processing can be applied, therefore detailed description thereof will be omitted.

The drive means 13 receives inputs of data which has been stored in the frame memory 11 and bit-incremented compared to each color-reduced component. Therefore, the drive means 13 can carry out a correction based on characteristics of FIG. 7 (for canceling out the reflectance characteristics) in place of a prior-art correction based on characteristics of FIG. 11 (for canceling out the reflectance characteristics).

Figures 6, 7:
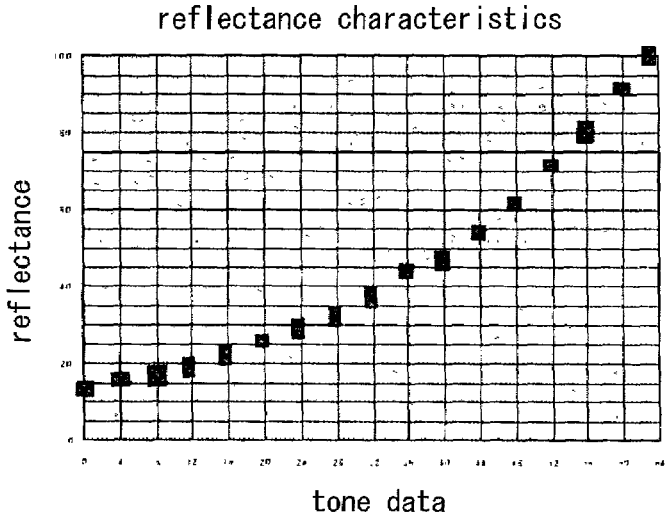
FIG. 6 is an exemplary view of the conversion table according to the invention.
FIG. 7 is a graph showing reflectance characteristics according to the invention.
Figure 11:
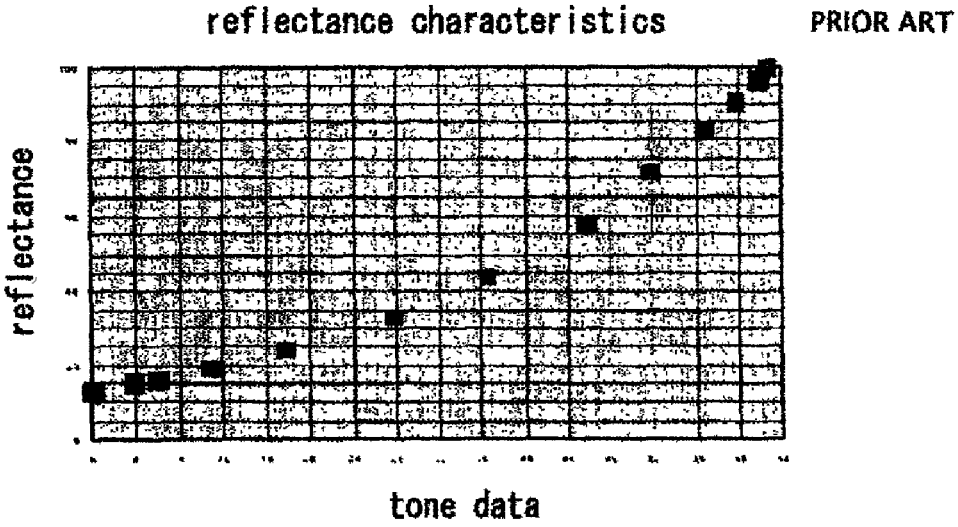
FIG. 11 is a graph showing reflectance characteristics of the display unit according to the invention.

As becomes clear by comparison between FIG. 11 and FIG. 7, in the present embodiment, tones that can be displayed are increased fourfold for finer display. In particular, the tones can be smoothly changed in halftones where irregular colors easily become conspicuous, thus the display quality is considerably improved.

Accordingly, when an LCD 14 of FIG. 1 can display 64 tones, the performance can be sufficiently exhibited. In FIG. 1, the LCD (any of the reflective, transmissive, and semi-transmissive types) is used as a display device, however, a CRT or a plasma display can also be used.

Here, FIG. 1 should be the focus once again. In FIG. 1, the memory capacity of the frame memory 11 is the same as that of FIG. 8 showing the prior art (12 bits per one pixel). However, the data which has been color-reduced by the pseudo-tone processing means 10 is stored in the frame memory 11. The color-reduced data of the frame memory 11 is bit-incremented by the tone correction means 12 and output to the drive means 13.

That is, a series of processes, "from color reduction, storage, bit-increment, correction by the drive means 13 to display" are carried out. Thus, a smoother tone display is attained using the same memory amount as that of the prior art.

As a matter of course, herein, in accordance with the aforementioned principle, the ratio of each ROB component when carrying out color-reduction is provided as:

G component>R component>B component in line with human visual performance, wherefore a high-quality display which is even easier to view is realized.

The pseudo-tone processing means 10 and the tone correction means 12 in FIG. 1 may be constructed in either the software or hardware. The tone correction means 12 may be omitted. If the tone correction means 12 is omitted, the data inside the frame memory I 1 is output to the drive means 13. If the drive means 13 for 6 bits is used for each RGB component as shown in FIG. 1, it is preferable to add dummy data so that each RGB component is 6 bits.

In the present example, the dummy data contains 2 bits for the R component, 1 bit for the G component, and 3 bits for the B component.

Alternatively, in terms of the respective RGB components, it is also possible to use a drive means (unillustrated) corresponding to different bit numbers (R component of 4 bits, G component of 5 bits, and B component of 3 bits).

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display unit comprising:

a display device;

a pseudo-tone processing means for receiving inputs of display data;

means in said pseudo-tone processing means for color-reducing each RGB component of said display data by pseudo-tone processing to produce color-reduced display data;

said pseudo-tone processing means includes means for performing color reduction so that the tone number reflects a contribution of each RGB component to brightness;

a frame memory for storing said color-reduced display data;

a one-dimensional bit conversion table that includes $2^N$ conversion data, wherein N is the number of reduced bits;

a tone correction means which references the one-dimensional bit conversion table for bit-incrementing said color-reduced display data stored in said frame memory; and a drive means for driving said display device with said color-reduced display data from said frame memory.

2. A display unit as set forth in claim 1, wherein the tone number of the G component after color reduction is from about two to about 20 times the tone number of the B component.

3. A display unit as set forth in claim 1, wherein:

the tone numbers after color reduction are R component:G component:B component=2:4:1.

4. A display unit as set forth in claim 1, wherein:

the tone numbers after color reduction are R component=16, G component=32, and B component=8.

5. The display unit of claim 1, further comprising:

a tone correction means, located downstream from the frame memory, for bit incrementing said color-reduced display data; and at least one bit conversion table containing tone corrections that include least significant bits.

6. A display unit comprising:

a display device;

a pseudo-tone processing means for receiving inputs of display data;

means in said pseudo-tone processing means for color-reducing each RGB component of said display data by means of pseudo-tone processing to produce color-reduced display data;

a frame memory for storing said color-reduced display data;

a one-dimensional bit conversion table that includes $2^N$ conversion data, wherein N is the number of reduced bits;

a tone correction means which references the one-dimensional bit conversion table for bit-incrementing said color-reduced display data stored in said frame memory;

a drive means for driving said display device using data derived from said color-reduced display data stored in said frame memory; and said pseudo-tone processing means including means for performing color reduction so that the tone number of bits in each RGB component after color reduction becomes G component>R component>B component.

7. A display unit as set forth in claim 6, wherein the tone number of the G component after color reduction is from about two to about 20 times the tone number of the B component.

8. A display unit as set forth in claim 6, wherein:

the tone numbers after color reduction are R component:G component:B component=2:4:1.

9. A display unit as set forth in claim 6, wherein:

the tone numbers after color reduction are R component=16, G component=32, and B component=8.

10. The display unit of claim 6, further comprising:

a tone correction means, located downstream from the frame memory, for bit incrementing said color-reduced display data; and at least one bit conversion table containing tone corrections that include least significant bits.

11. A display unit comprising:

a display device;

a pseudo-tone processing means which receives inputs of display data;

means in said pseudo-tone processing means for color-reducing each RGB component of said display data by means of pseudo-tone processing to produce color-reduced display data;

a frame memory for storing said color-reduced display data;

a tone correction means which references at least one one-dimensional bit conversion table for bit-incrementing said color-reduced display data stored in said frame memory;

the at least one one-dimensional bit conversion table containing tone corrections that include least significant bits and includes $2^N$ conversion data, wherein N is the number of reduced bits; and a drive means for driving said display device using the bit-incremented display data.

12. A display method comprising the steps of:

receiving input display data;

color-reducing each RGB component of said display data by means of pseudo-tone processing to produce color-reduced display data;

storing said color-reduced display data in a frame memory;

accessing bit conversion data stored in a one-dimensional bit conversion table that includes $2^N$ conversion data, wherein N is the number of reduced bits;

bit-incrementing said color-reduced display data by a tone correction means referencing the bit conversion data;

driving a display device using data derived from said color-reduced display data stored in said frame memory; and the step of color-reducing setting a tone number of each RGB component after color reduction as G component>R component>B component.

13. A display method as set forth in claim 12, wherein:

said tone number of said G component after color reduction is from about 2 to about 20 times said tone number of the B component.

14. A display method as set forth in claim 12, wherein:

said tone numbers after color reduction are R component:G component:B component=2:4:1.

15. A display method as set forth in claim 12, wherein:

said tone numbers after color reduction are R component=16, G component=32, and B component=8.

16. The method of claim 12, further comprising the step of:

bit-incrementing the color-reduced display data in a tone correction means located downstream from the frame memory;

wherein the tone correction means references at least one bit conversion table.

17. A display method comprising the steps of:

receiving input display data;

color-reducing each RGB component of said display data by means of pseudo-tone processing to produce color-reduced display data;

storing said color-reduced display data in a frame memory;

accessing bit conversion data stored in a one-dimensional bit conversion table that includes $2^N$ conversion data, wherein N is the number of reduced bits;

bit-incrementing said color-reduced display data by a tone correction means referencing the bit conversion data;

driving a display device using data derived from said color-reduced display data stored in said frame memory; and the step of color-reducing includes setting tone number to reflect a contribution of each RGB component to brightness.

18. A display method as set forth in claim 17, wherein:

said tone number of said G component after color reduction is from about 2 to about 20 times said tone number of the B component.

19. A display method as set forth in claim 17, wherein:

said tone numbers after color reduction are R component:G component:B component=2:4:1.

20. A display method as set forth in claim 17, wherein:

said tone numbers after color reduction are R component=16, G component=32, and B component=8.

21. The method of claim 17, further comprising the step of:

bit-incrementing the color-reduced display data in a tone correction means located downstream from the frame memory;

wherein the tone correction means references at least one bit conversion table.

22. A display method comprising the steps of:

receiving input of display data;

color-reducing each RGB component of said display data by means of pseudo-tone processing to produce color-reduced display data;

storing said color-reduced display data in a frame memory;

bit-incrementing said display data after the step of color-reducing stored in the frame memory to produce bit-incremented display data;

performing the bit-incrementing step in a tone correction means located downstream from the frame memory; and driving a display device with said bit-incremented display data;

wherein the tone correction means references at least one one-dimensional bit conversion table that includes $2^N$ conversion data, wherein N is the number of reduced bits.

* * * * *

UNITED STATES PATENT AND TRADEMARK OFFICE

CERTIFICATE OF CORRECTION

PATENT NO. : 6,987,498 B2
DATED : January 17, 2006
INVENTOR(S) : Jun Ikeda et al.

It is certified that error appears in the above-identified patent and that said Letters Patent is hereby corrected as shown below:

Column 1,
Line 52, after "small" insert -- . --.

Column 2,
Lines 41 and 45, after "problem" insert -- , --.

Column 5,
Line 55, delete "stir" and insert -- still --.

Column 7,
Line 11, delete "the" and insert -- The --.
Line 55, after "nm" delete ",." and insert -- . --.

Column 8,
Line 32, delete "12 bit-data" and insert -- 12-bit-data --.

Column 9,
Line 22, delete "ROB" and insert -- RGB --.
Line 33, delete "I 1" and insert -- 11 --.

Signed and Sealed this

Sixteenth Day of May, 2006

JON W. DUDAS
*Director of the United States Patent and Trademark Office*